US008978563B2

(12) United States Patent
Rodet et al.

(10) Patent No.: US 8,978,563 B2
(45) Date of Patent: Mar. 17, 2015

(54) MOTOR-DRIVEN BOGIE FOR A STREETCAR

(75) Inventors: Alain Rodet, Chalon sur Saône (FR); Jean-Christophe Loiseau, Le Creusot (FR); Christophe Eche, Montchanin (FR)

(73) Assignee: ALSTOM Transport SA, Levallois-Perret (FR)

( * ) Notice: Subject to any disclaimer, the term of this patent is extended or adjusted under 35 U.S.C. 154(b) by 790 days.

(21) Appl. No.: 12/594,808

(22) PCT Filed: Mar. 14, 2008

(86) PCT No.: PCT/FR2008/050437

§ 371 (c)(1),
(2), (4) Date: Jan. 20, 2010

(87) PCT Pub. No.: WO2008/129207

PCT Pub. Date: Oct. 30, 2008

(65) Prior Publication Data

US 2010/0132586 A1 Jun. 3, 2010

(30) Foreign Application Priority Data

Apr. 5, 2007 (FR) ..... 07 54311

(51) Int. Cl.

| | |
|---|---|
| ***B61C 9/00*** | (2006.01) |
| ***B61F 3/04*** | (2006.01) |
| ***B61C 9/52*** | (2006.01) |
| ***B61D 13/00*** | (2006.01) |

(52) U.S. Cl.

CPC . *B61C 9/52* (2013.01); *B61D 13/00* (2013.01); *B61F 3/04* (2013.01)

USPC ..... 105/133; 105/34.1

(58) Field of Classification Search

USPC ..... 105/34.1, 96, 96.1, 120, 122, 133, 135, 105/158.2, 182.1

See application file for complete search history.

(56) References Cited

U.S. PATENT DOCUMENTS

| | | | | |
|---|---|---|---|---|
| 4,787,318 | A * | 11/1988 | Vogel | 105/136 |
| 4,867,072 | A * | 9/1989 | Kleim et al. | 105/133 |
| 6,601,520 | B2 * | 8/2003 | Eche et al. | 105/34.1 |
| 2002/0195018 | A1 | 12/2002 | Eche et al. | |

FOREIGN PATENT DOCUMENTS

| | | | |
|---|---|---|---|
| DE | 2910392 | A1 | 9/1980 |
| EP | 1247713 | A | 10/1982 |
| EP | 1270359 | A | 1/2003 |
| EP | 1247713 | B1 | 12/2006 |
| FR | 2491023 | A | 4/1982 |
| FR | 2604676 | A | 4/1988 |

OTHER PUBLICATIONS

International Search Report of corresponding PCT/FR2008/050437.

* cited by examiner

*Primary Examiner* — R. J. McCarry, Jr.

(74) *Attorney, Agent, or Firm* — Davidson, Davidson & Kappel, LLC

(57) ABSTRACT

A powered bogie for a railway vehicle, including one or more motors mounted on the bogie chassis, the front and rear reducing gears being arranged between, on the one hand, a longitudinal plane midway between the two front wheels and midway between the two rear wheels and, on the other hand, a longitudinal plane passing through the front wheel and the rear wheel situated on the same, first transverse side of the bogie is provided.

11 Claims, 5 Drawing Sheets

MOTOR-DRIVEN BOGIE FOR A STREETCAR

This claims priority to French Application No. 07 54311, filed Apr. 5, 2007 through international application PCT/FR2008/050437, filed Mar. 14, 2008, the entire disclosures of which are hereby incorporated by reference herein.

The invention relates in general to railway vehicles, particularly trams.

More precisely, according to a first aspect, the invention relates to a powered bogie for a railway vehicle, the bogie being of the type comprising:

- a chassis;
- two front wheels transversely spaced apart from one another and two rear wheels transversely spaced apart from one another, the front and rear wheels being connected to the chassis, the front wheels being longitudinally spaced apart from the rear wheels;
- at least one driving motor;
- transmission means comprising a front reducing gear for coupling the front wheels to the or a motor and a rear reducing gear for coupling the rear wheels to the or a motor.

BACKGROUND OF THE INVENTION

Such a bogie is known from document FR-A-2 604 676, which describes a tram comprising a body and at least one powered bogie. This bogie comprises a single motor fixed below the body and offset longitudinally forwards relative to the bogie chassis. The front reducing gear is placed between the two front wheels and is coupled directly to the motor. The rear reducing gear is placed outside the wheels and is driven via the front reducing gear.

Such a bogie has the advantage of allowing a low central corridor to be arranged in the chassis of the body, allowing access without a step to the entire tram. By contrast, the integration of the motor into the structure of the body beyond the bogie region is restrictive, because it prevents the provision of seats or of an access door above the motor. Moreover, driving the two reducing gears in series is complex from a mechanical point of view.

SUMMARY OF THE INVENTION

Within this context, the object of the invention is to propose a powered bogie which allows a wide low corridor to be arranged in the chassis of the body, but which is mechanically less complex and easier to integrate into the body of the tram.

For this purpose, the invention relates to a powered bogie for a railway vehicle of the aforementioned type, characterised in that the or each motor is mounted on the bogie chassis, the front and rear reducing gears being arranged between, on the one hand, a longitudinal plane midway between the two front wheels and midway between the two rear wheels and, on the other hand, a longitudinal plane passing through the front wheel and the rear wheel situated on the same, first transverse side of the bogie.

The bogie may also exhibit one or more of the features below, taken individually or in any of the technically feasible combinations:

- the front and rear reducing gears are arranged in positions symmetrical to one another about a transverse plane midway between the front and rear wheels;
- the bogie comprises a single driving motor aligned longitudinally between the front and rear reducing gears;
- the bogie comprises two driving motors aligned longitudinally between the front and rear reducing gears;

- the bogie comprises front and rear wheel braking elements and secondary suspension components suitable for suspending a railway vehicle body on the bogie chassis, the braking elements and the secondary suspension components being situated outside the bogie relative to the wheels;
- the bogie comprises primary suspension components situated between the transmission means and the bogie chassis, the primary suspension components being placed inside the bogie relative to the wheels; and
- at least some primary suspension components are low components, each situated entirely below a level between 200 mm and 400 mm relative to the rolling plane of the bogie, for front and rear wheels with a diameter of 590 mm.

According to a second aspect, the invention relates to a railway vehicle comprising:

- a body which is elongate in shape in a principal direction, provided with a body chassis;
- at least one bogie of the type described above, connected to the body and arranged below the body chassis;
- the body chassis comprising a first raised portion above the front and rear wheels situated on the first transverse side of the bogie and above the front and rear reducing gears, a second raised portion at least above the front and rear wheels situated on a second transverse side of the bogie opposite the first, and a lowered portion forming a circulation corridor, substantially parallel to the principal direction, between the first and second raised portions.

The railway vehicle may also have one or more of the following features:

- the circulation corridor is offset transversely towards the second raised portion relative to a median plane of the body and parallel to the principal direction;
- the bogie is connected to the body by pivot connection means;
- the bogie is non-pivoting relative to the body;
- the circulation corridor extends from the front and rear reducing gears to the front and rear wheels situated on the second side of the bogie; and
- the bogie comprises primary suspension components arranged directly inside the bogie relative to the front and rear wheels situated on the second side of the bogie, the circulation corridor extending from the front and rear reducing gears to said primary suspension components.

BRIEF DESCRIPTION OF THE DRAWINGS

Other features and advantages of the invention will emerge from the description given below, for guidance and not by way of limitation, with reference to the accompanying drawings in which.

DETAILED DESCRIPTION

Figure 1:
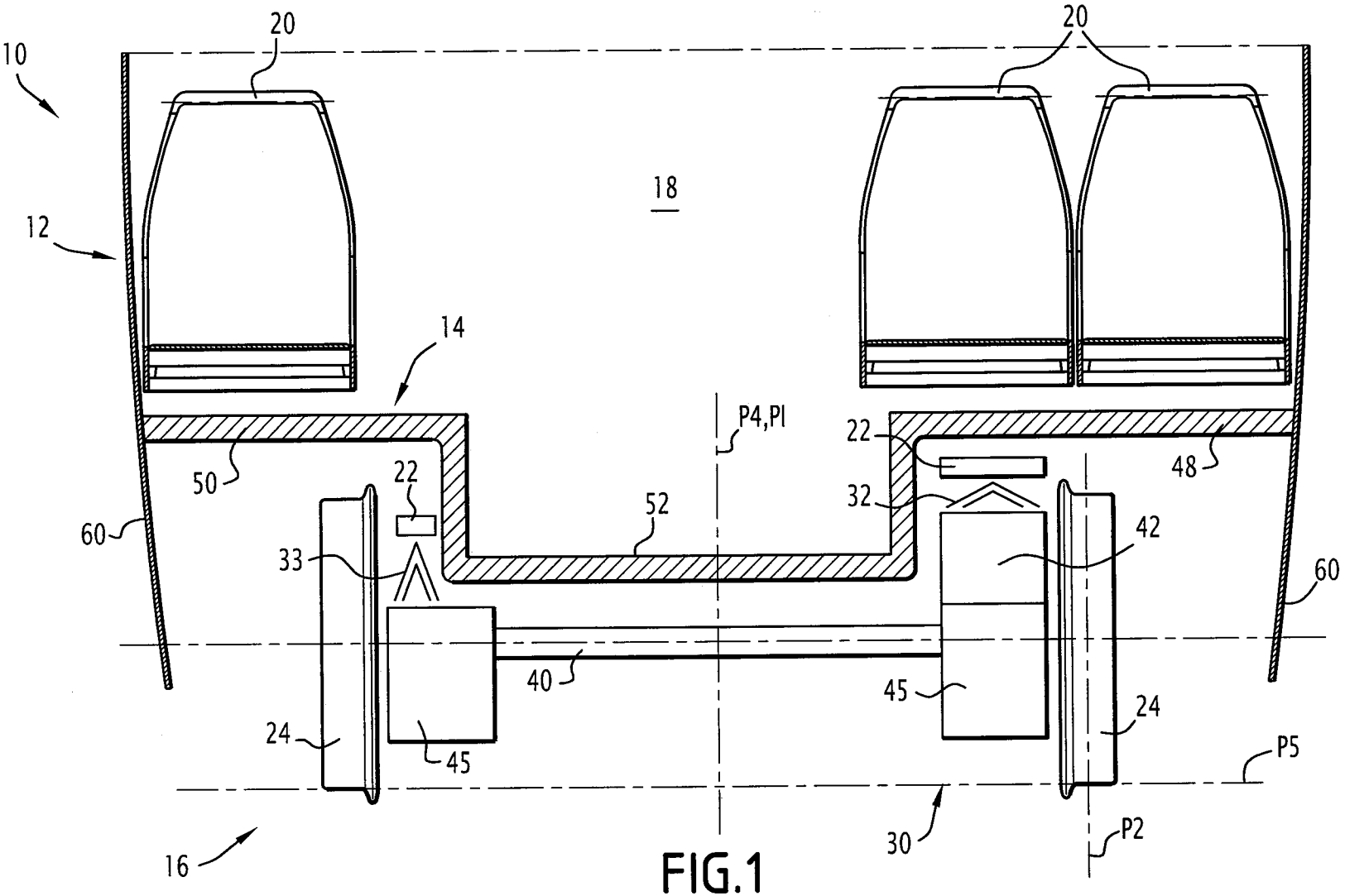
FIG. 1 is a cross-sectional view of a tram comprising a bogie according to a first embodiment of the invention, the section through the bogie being taken along the arrows I-I of FIG. 2.

The tram 10 illustrated in FIG. 1 comprises for example a body 12 which is elongate in shape in a principal direction, provided with a body chassis 14, and two bogies 16, each connected to the body 12 and arranged beneath the chassis 14. The body 12 comprises an inner space for passengers 18, delimited towards the bottom by the chassis 14, and seats 20 attached to the chassis 14. The seats 20 are typically arranged in several rows extending perpendicular to the principal direction. The seats are oriented in such a way that the passengers seated in the seats are looking in the principal direction.

The bogies 16 are suitable for supporting and guiding the body 12 when the tram travels along a track.

Figure 2:
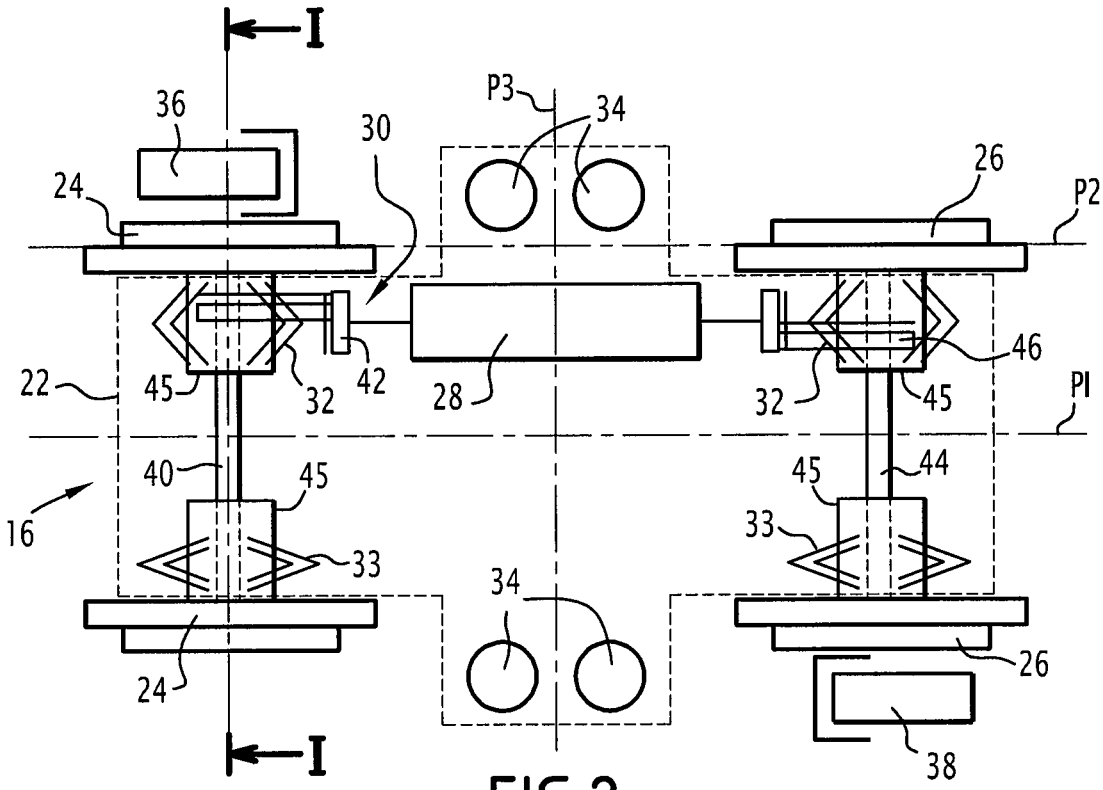
FIG. 2 is a schematic plan view of the bogie of FIG. 1.

In a first embodiment of the invention, each bogie comprises, as shown schematically in FIG. 2:

- a bogie chassis 22;
- two front wheels 24 and two rear wheels 26;
- a driving motor 28;
- transmission means 30 suitable for transmitting the torque generated by the motor 28 to the front wheels 24 and the rear wheels 26;
- primary suspension components 32 and 33, and secondary suspension components 34;
- front and rear brakes 36 and 38.

The chassis 22 typically comprises two longitudinal side members (not shown), and two transverse cross members (not shown) attached rigidly to one another. Only the outer contour of the chassis 22 is shown in FIG. 2. The contour is represented by dashed lines.

The front wheels 24 are coaxial, spaced transversely from one another, and are connected to the chassis 22. Similarly, the rear wheels 26 are coaxial, spaced transversely from one another, and connected to the chassis 22.

The front wheels 24 are spaced longitudinally from the rear wheels 26.

The transmission means 30 comprise for example a front axle 40 connecting the front wheels 24 to one another in rotation and a front reducing gear 42 for coupling the front wheels 24 to the motor 28. The front reducing gear 42 transmits the torque from the motor 28 to one of the front wheels 24, the torque being transmitted from said wheel to the other front wheel 24 by the front axle 40. In a variant, the front reducing gear 42 transmits the torque from the motor 28 to the axle 40, which entrains the two front wheels 24.

The transmission means 30 also comprise a rear axle 44 connecting the two rear wheels 26 to one another in rotation and a rear reducing gear 46 for coupling the rear wheels 26 to the motor 28. As at the front, the rear reducing gear 46 transmits the torque from the motor 28 to one of the rear wheels 26 or to the rear axle 44.

Each of the axles 40 and 44 is guided in rotation by two axle boxes 45, arranged directly inside the wheels associated with the axle and extending only over a portion of the transverse length of the axle. In a variant, each of the axles 40 and 44 comprises a rotating shaft connected to the wheels in rotation, and a casing providing mechanical rigidity for the axle and guiding the rotating shaft in rotation. The casing extends virtually from one of the wheels associated with the axle to the other.

The motor 28 and the front 42 and rear 46 reducing gears are mounted on the bogie chassis 22 and are therefore independent from the body 12. They are arranged between, on the one hand, a longitudinal plane P1 midway between the two front wheels 24 and midway between the two rear wheels 26 and, on the other hand, a longitudinal plane P2 passing through the front wheel 24 and the rear wheel 26 situated on the same, first transverse side of the bogie 16.

The plane P1 is, as shown in FIG. 2, equidistant from the two front wheels 24 and equidistant from the two rear wheels 26. It generally corresponds to the median longitudinal plane of the bogie 16. The motor 28 and the reducing gears 42 and 46 are preferably situated as close as possible to the plane P2.

Moreover, the positions of the front 42 and rear 46 reducing gears are symmetrical to one another about a transverse plane P3 midway between the front and rear wheels 24 and 26. As shown in FIG. 2, the plane P3 is equidistant from the respective axes of rotation of the front wheel 24 and the rear wheel 26 situated on the first side of the bogie. It is also equidistant from the respective axes of rotation of the front wheel 24 and the rear wheel 26 situated on the second side of the bogie opposite the first.

The motor 28, the front reducing gear 42 and the rear reducing gear 46 are aligned longitudinally, the motor 28 being placed longitudinally between the reducing gears 42 and 46. The motor 28 is equidistant from the two axles 40, 44.

The front and rear reducing gears 42 and 46 are different from one another and are chosen to drive the front and rear wheels in the same direction of rotation.

The front reducing gear 42 is attached rigidly to the front axle box 45 situated on the first side, or to the casing of the front axle 40, as appropriate. Likewise, the rear reducing gear 46 is attached rigidly to the rear axle box 45 situated on the first side, or to the casing of the rear axle 44, as appropriate.

The bogie 16 comprises four primary suspension components 32 and 33, suitable for suspending the bogie chassis 22 on the axles 40 and 44.

Two primary suspension components 32 are situated vertically above the front 42 and rear 46 reducing gears, and are situated between the reducing gears 42 and 46 and the bogie chassis 22 (FIG. 1).

Two further primary suspension components 33 are arranged between the plane P1 and the wheels 24, 26 situated on the second side of the bogie, as close as possible to the wheels.

In the casing of axles mounted in axle boxes 45, the two components 33 are arranged between the front and rear axle boxes 45 and the bogie chassis 22. In the casing of axles with a shaft and a casing, the two components 33 are arranged between the casings of the front and rear axles 40 and 44 and the bogie chassis 22.

The primary suspension components 32 and 33 are rubber/metal sandwiches of the type described in FR-1 536 401. They each comprise a plurality of layers of a resilient material such as rubber, and a plurality of metal plates inserted between the layers of resilient material and adhering to said layers. Each of the components 32 and 33 is chevron-shaped.

The primary suspension components 33 each have a transverse width of approximately 100 mm. The components 32 each have a transverse width of 300 mm and a height such that the bogie chassis 22, above the primary suspension component 32, is situated at a height of 500 to 550 mm above the rolling plane P5 of the bogie, for wheels with diameters when new of 590 mm.

The bogie typically comprises four secondary suspension components 34, each consisting of a spiral spring inserted between the bogie chassis 22 and the body chassis 14.

The four secondary suspension spiral springs 34 are arranged symmetrically about the planes P1 and P3. Two springs 34 are placed on the first side of the bogie, transversely outside the bogie relative to the wheels 24 and 26. The two other spiral springs 34 are arranged on the second side of the bogie, transversely outside said bogie relative to the wheels 24 and 26. The spiral springs 34 are situated longitudinally between the front 24 and rear 26 wheels.

The front brake 36 is arranged on the first side of the bogie, transversely outside the bogie relative to the wheels 24 and 26 situated on the first side. The rear brake 38 is arranged on the second side of the bogie, transversely outside said bogie relative to the wheels 24 and 26 situated on the second side.

As shown in FIG. 1, the body chassis 14 has a first raised portion 48 in line with the front and rear wheels 24, 26 situated on the first transverse side of the bogie, and above the motor 28 and the front and rear reducing gears 42 and 46. It comprises a second raised portion 50 above the front and rear wheels 24 and 26 situated on the second transverse side of the bogie, and a low portion 52 between the first and second raised portions 48 and 50.

In the first embodiment of the invention, the second raised portion 50 covers the chevron-shaped primary suspension components 33.

The first portion 48 is relatively wider than the second perpendicular to the principal direction, because it covers not only the wheels but also the reducing gears and the motor. The low portion 52 forms a circulation corridor inside the body, said corridor being substantially parallel to the principal direction. The corridor is offset transversely towards the second raised portion 50 relative to the median plane P4 of the body 12 and extends parallel to the principal direction.

The circulation corridor is situated at a level of approximately 480 mm relative to the rolling plane of the bogie. Viewed in a plane perpendicular to the principal direction, it extends virtually from the reducing gears 42 and 46 or the motor 28 to the primary suspension components 33 situated on the second side. It is therefore particularly wide, and is approximately 750 mm wide in the non-pivoting version of the bogie.

Each row of seats of the body 12 comprises for example three seats 20, two seats 20 arranged side by side above the first raised portion 48 and a single seat 20 situated above the second raised portion 50. The seats 20 hardly overhang within the corridor and thus hardly encroach on the width of the corridor.

The bogie 16 may be mounted so as to be pivoting or non-pivoting on the body 12. A pivoting bogie is connected to the body 12 by pivot connection means about an axis substantially perpendicular to the rolling plane P5 of the tram and can fit in the curved path followed by the tram. The maximum pivoting amplitude of the bogie relative to the body is approximately 12°.

A non-pivoting bogie is connected to the body by connection means allowing very limited pivoting about an axis perpendicular to the rolling plane, generally of less than 2°.

It will be noted that the longitudinal direction of the bogie is substantially parallel to the principal direction of the body in the casing of a fixed bogie. In the casing of a pivoting bogie, the longitudinal direction of the bogie is parallel to or forms an angle of less than 12° with the principle direction of the body, the inclination varying as a function of the course of the path followed by the tram.

A second embodiment of the invention will now be described in relation to FIGS. 3 to 6. Identical elements or elements performing the same function in the first and second embodiments will be denoted by the same reference numerals. Only the points in which the second embodiment differs from the first will be detailed.

Figure 3:
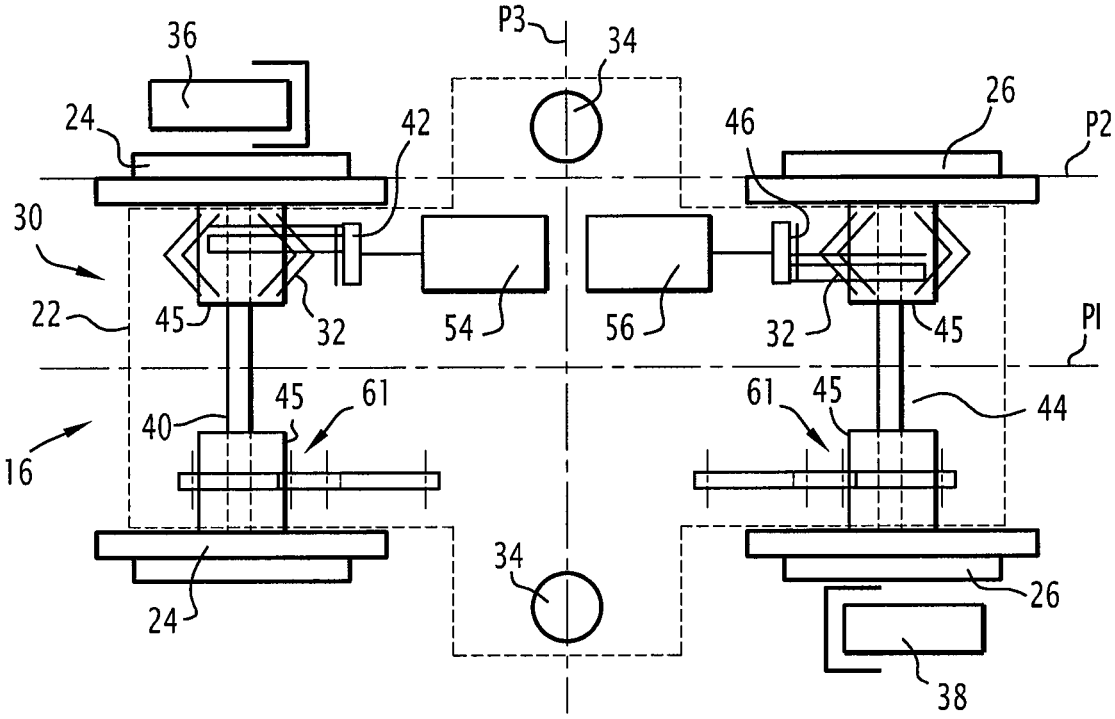
FIG. 3 is a view similar to that of FIG. 3, for a second embodiment of the invention.
Figure 4:
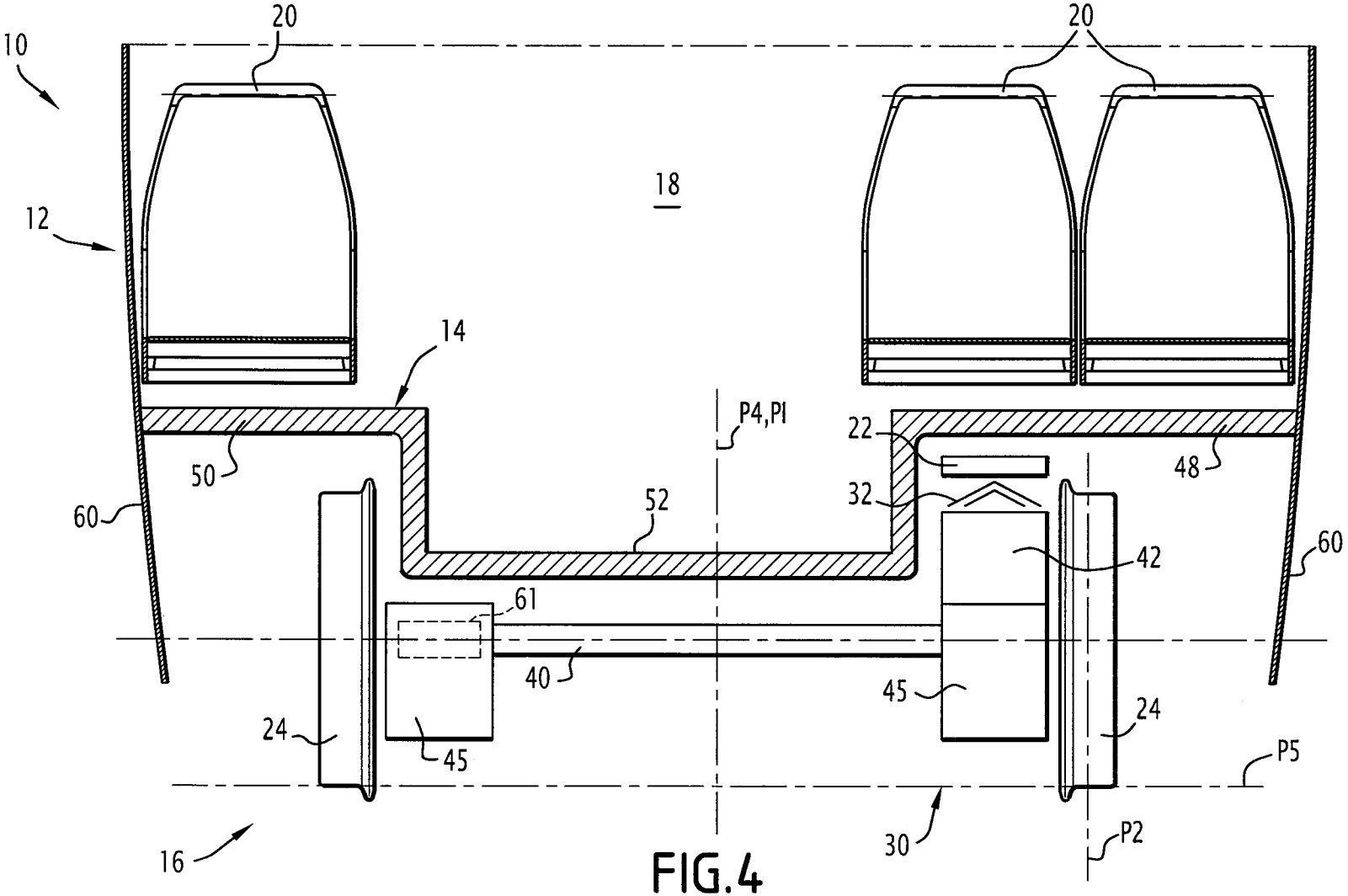
FIG. 4 is a view similar to that of FIG. 1, for the second embodiment of the invention.

As shown in FIG. 3, the bogie 16 comprises two motors, a front motor 54 coupled to the front reducing gear 42 and a rear motor 56 coupled to the rear reducing gear 46. The positions of the front and rear reducing gears 42 and 46 are substantially the same as in the embodiment of FIG. 2. The front and rear motors 54 and 56 are arranged in positions symmetric to one another about the plane P3. They are placed between the reducing gears 42 and 46 and are aligned longitudinally with the reducing gears 42 and 46.

The bogie 16 only comprises a total of two spiral springs 34 instead of four. The two springs 34 are arranged in the plane P3 in such a way as to be symmetrical to one another about the plane P1 and are placed outside the bogie relative to the wheels 24, 26.

As can be seen in FIG. 3, the primary suspension components 61 situated on the side of the bogie are low components.

The front primary suspension component 61 comprises:

- two connecting rods 62 and 64, connected to the chassis 22 by first connection points 66 and 68 respectively, and to the axle box 45 by second connection points 70 and 72 respectively;
- a resilient component 74 inserted between the two connecting rods 62 and 64 to define at least the vertical stiffness of the primary suspension component 61.

The two connecting rods 62 and 64 are placed in the same vertical plane, in other words in the same plane perpendicular to the rolling plane P5 of the bogie, the connecting rod 62, situated above the connecting rod 64, being referred to as the upper connecting rod and the connecting rod 64 being referred to as the lower connecting rod in the description that follows.

At rest, the two connecting rods 62 and 64 are substantially parallel to one another and extend in a longitudinal direction corresponding substantially to the direction of the side members of the chassis 22. They are therefore perpendicular to the axle 40. Between the first and second respective connection points thereof the connecting rods 62 and 64 have substantially the same longitudinal length.

Figure 5:
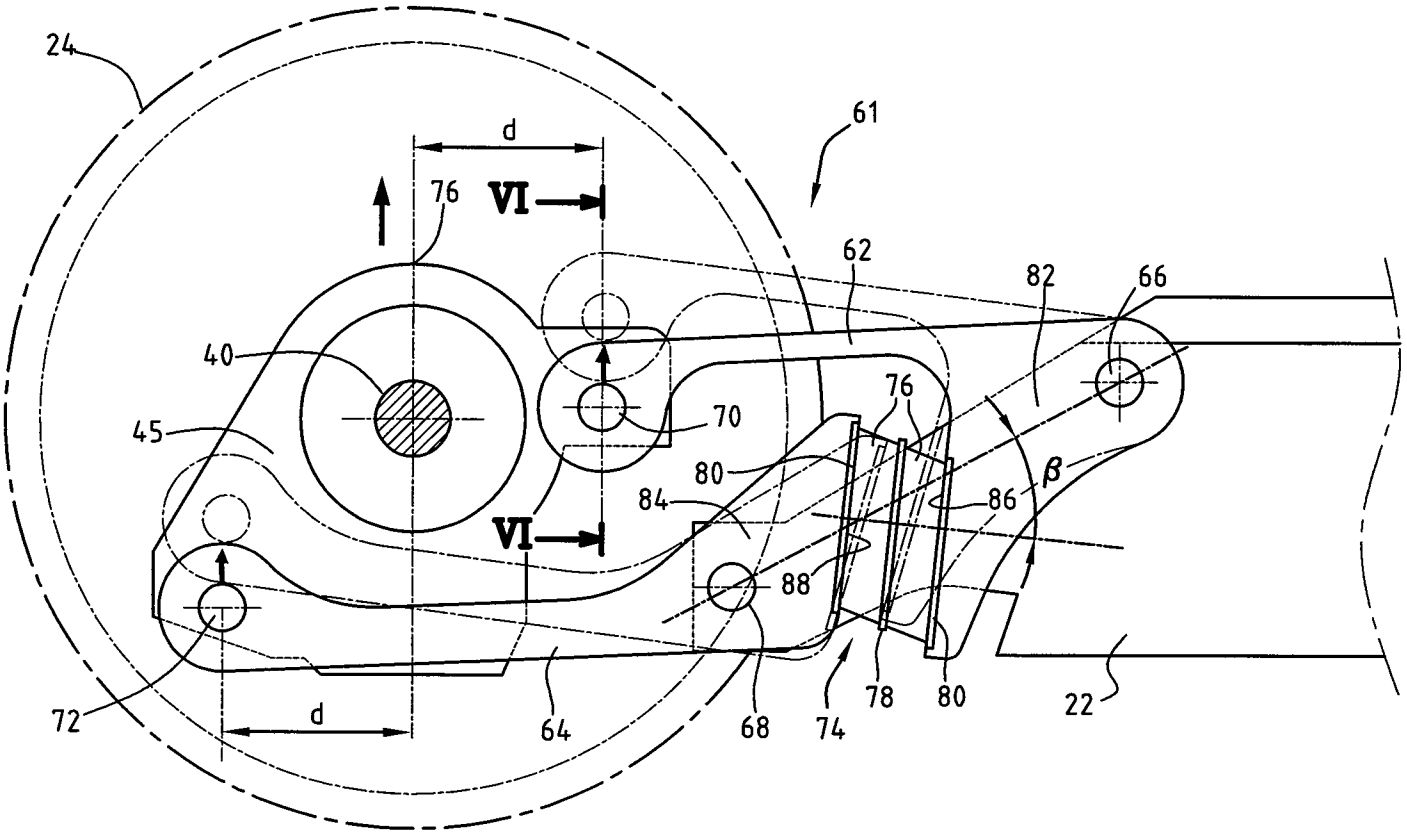
FIG. 5 is a side view of a front portion of the bogie of FIG. 3, showing in detail the structure of a low primary suspension component of said bogie, the two connecting rods of the suspension component being illustrated at rest in solid lines and in dashed and dotted lines after having been moved under the effect of vertical loading applied to the wheel from bottom to top.

As shown in FIG. 5, the two connecting rods 62 and 64 are offset longitudinally relative to one another when the primary suspension component 61 is at rest and also when it is under load. Therefore, as shown in FIG. 5, the upper connecting rod 62 is offset to the right of FIG. 5, in other words towards the chassis 22 relative to the lower connecting rod 64. In order to distribute the load between the two connecting rods 62 and 64, the second connection points 70 and 72 of the upper and lower connecting rods 62 and 64 are offset longitudinally on either side of the axle 40. Thus, in the embodiment of FIG. 5, the connection point 70 of the upper connecting rod is offset relative to the central transverse axis of the axle 40 by a distance d towards the chassis 22. Symmetrically, the connection point 72 of the lower connecting rod 64 is offset symmetrically relative to the central axis of the axle 40 by the same distance d in the longitudinal direction, opposite the chassis 20. With this arrangement, there is an even distribution of the load between the two connecting rods 62 and 64 when the resilient component 74 is centred between the connection points 66 and 68, in other words when the centre of the component 74 is placed equidistant from the points 66 and 68 on the straight line passing through the two points 66 and 68.

At rest, the connecting rods 62 and 64 extend substantially horizontally, in other words substantially parallel to the rolling plane P5 of the bogie, and are situated entirely at a vertical level lower than the highest point 76 of the axle box 45. The highest point 76 of the axle box is the point of this box situated highest relative to the rolling plane of the bogie.

The resilient component 74 is a rubber/metal sandwich of the type described in patent application FR-1 536 401. The resilient component 74 comprises a plurality of rubber layers 76 parallel to one another, a plurality of metal plates 78 inserted between the layers of rubber 76, and metal end plates 80 arranged at the bottom and top of the sandwich. The plates 78 and 80 are parallel to one another and parallel to the layers of rubber 76. Each layer of rubber 76 is therefore arranged between two metal plates 78 and/or 80 and adheres to said plates.

The axis of compression of such a resilient component is perpendicular to the plates 78 and 80 and to the layers of rubber 76.

Such a sandwich has a substantial stiffness both in compression and in shearing, in other words in response respectively to a load applied in a direction perpendicular to the plane of the plates 78, 80 and layers 76, and parallel to the plane of said plates and layers.

The upper and lower connecting rods 62 and 64 each comprise a lateral extension 82 and 84 respectively, defining mutually opposite support surfaces 86 and 88 respectively, for the resilient component 74. The resilient component 74 is held between the surfaces 86 and 88. Said surfaces 86 and 88 are parallel to one another, the end plates 80 being placed on the support surfaces and rigidly attached thereto.

The support surfaces 86 and 88 are oriented in such a way that the axis of compression of the resilient component 74 forms an angle β of between 0° and 90° relative to the axis passing through the first connection points 66 and 68 of the two connecting rods. Preferably, the angle β is between 20° and 50°, and typically has a value of 30°.

The two connecting rods 62 and 64 are connected to the axle box 45 of the bogie by second connection points thereof 70 and 72 respectively by means of resilient cylindrical articulations. The two connecting rods are connected to the bogie chassis 22 at the first connection points thereof 66 and 68 respectively, and also by cylindrical resilient articulations.

Figure 6:
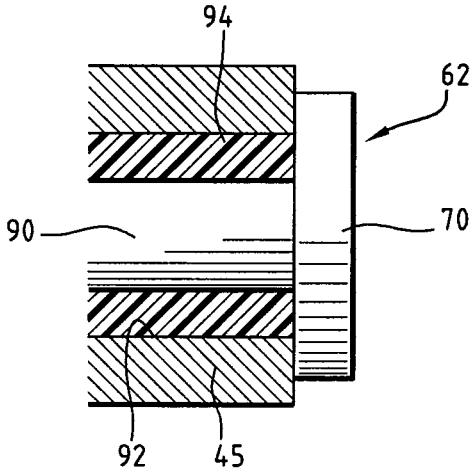
FIG. 6 is a cross-sectional view of an articulation of the upper connecting rod of FIG. 5, viewed along the incidence of the arrows VI.

The connecting rods 62 and 64 comprise at each of the connection points 66, 68, 70 and 72 a transverse axis end 90 engaged in a cylindrical opening 92 arranged, depending on circumstances, either in the axle box 45, or in the bogie chassis 22 (see FIG. 6). A cylindrical resilient sleeve 94, for example of natural or synthetic rubber, is inserted between the axis end 90 and the peripheral wall of the opening 92. The axis end 90, the opening 92 and the sleeve 94 are coaxial, in terms of the transverse axis. The sleeve 94 adheres by an inner face to the axis end 90 and by an outer face to the peripheral wall of the opening 92.

The rear low primary suspension component 61 is similar to the front low primary suspension component 61. Each component 61 is situated at rest entirely below a level between 200 mm and 400 mm above the rolling plane P5 of the bogie, preferably between 250 mm and 350 mm and typically having a value of 300 mm for wheels with a diameter when new of 590 mm.

The operation of the above suspension component will now be described briefly.

Under the effect of a load or a fault in the track which causes the wheel 24 to rise, the connecting rods 62 and 64 drive the axle box 45 in a vertical movement. The unit formed by the chassis 22, the two connecting rods 62 and 64 and the axle box 45, connected by the connection points 66, 68, 70 and 72, forms a parallelogram.

When the wheel 24 is subject to a vertical load F from bottom to top, for example in the casing of a fault in the track, the connecting rods 62 and 64 each take up part of the load F at the second connection points thereof 70 and 72 respectively, because said first connection points are placed on either side of the axle. The distribution of the load between the two connecting rods is a function of the position of the resilient component 74 between the connection points 66 and 68.

Under the effect of this load, the connecting rods 62 and 64 pivot upwards relative to the chassis 22 about the first connection points 66 and 68, in other words clockwise in FIG. 5. Under the effect of this pivoting, the support surfaces 86 and 88 tend to draw closer. In the embodiment in FIG. 1, for which the angle β has a value of about 30°, the pivoting of the connecting rods 62 and 64 leads to both a compression load and a shearing load being applied to the resilient component 74. For an angle β of 90°, the resilient component works purely in compression. For an angle β of 0°, the resilient component works purely in shearing.

In parallel, the connecting rods 62 and 64 pivot relative to the axle box 45 about the second connection points 70 and 72, which move vertically upwards as illustrated with dashed and dotted lines in FIG. 5. Of course, the axle box 45 and the highest point thereof 76 are also subject to a vertical movement upwards, which is not illustrated in FIG. 5. The connecting rods 62 and 64 pivot clockwise in FIG. 5 relative to the axle box 45 and remain at a level lower than the highest point 76 of the axle box, which has moved upwards.

The pivoting of the connecting rods 62 and 64 leads to torsion, for each connecting rod, of the resilient sleeves 60 of the first and also the second connection point.

In the second embodiment of the invention, the second raised portion 50 of the floor of the body 14 only covers the wheels 24 and 26 situated on the second side. The low primary suspension components 61 are placed below the circulation corridor 52, which is itself situated, relative to the rolling plane P5 of the bogie, at a level between 280 mm and 480 mm, preferably between 330 mm and 430 mm, and typically having a value of 380 mm.

In this casing, the circulation corridor extends, viewed in a plane perpendicular to the principal direction, virtually from the reducing gears 42 and 46 or the motor 28 to the wheels 24 and 26 situated on the second side. It is 900 mm wide in the casing of a non-pivoting bogie and 650 mm wide in the casing of a pivoting bogie.

The bogie and railway vehicle described above have many advantages.

Because the motor or motors are mounted on the chassis, the drive train for transmission between the motor or motors and the wheels is shorter and mechanically simpler. Moreover, as the front and rear reducing gears are arranged, on the one hand, between the longitudinal plane midway between the wheels of the vehicle and the longitudinal plane passing through the wheels situated on the first side of the bogie, it is possible to arrange a particularly wide low circulation corridor in the body chassis. When the primary suspension components situated on the second side are chevron-shaped rubber/metal sandwiches, the corridor extends between, on the one hand, the reducing gears and, on the other hand, the primary suspension components situated on the second side, and is approximately 750 mm wide, in the casing of a non-pivoting bogie.

When the primary suspension components situated on the second side are low components, the corridor extends from the reducing gears to the wheels situated on the second side and is approximately 900 mm wide for a non-pivoting bogie and approximately 650 mm wide for a pivoting bogie.

When the primary suspension components situated on the second side are of the conventional type, for example chevron-shaped rubber/metal sandwiches, the transverse width thereof must be reduced in such a way as to maintain the width of the corridor, since the components are not covered by the corridor. This constraint no longer exists when primary suspension components of the low type are used, since these components are below the corridor.

The symmetrical arrangement of the motor or motors and reducing gears relative to the transverse plane midway between the wheels facilitates this arrangement.

The or each of the two driving motors of the bogie may advantageously be aligned longitudinally between the two reducing gears. The or each motor and the reducing gears have substantially the same dimensions transversely, so that there is a large free space between the or each motor and the reducing gears, on the one hand, and the wheels situated on the second side of the bogie to allow the body circulation corridor to pass through.

The brakes and secondary suspension springs of the bogie are placed outside the bogie relative to the wheels, so as not to impede the passage of the body circulation corridor.

Because of the arrangement of the motors and reducing gears on the bogie, the vehicle may have a particularly wide low corridor between two raised portions of the floor, suitable for accommodating up to four rows of three seats without encroaching on the corridor in the casing of a narrow body (less than 2400 mm wide), or twelve seats above the bogie. In the casing of a wider body (more than 2400 mm wide), it is possible to arrange four rows of four seats above the bogie without encroaching on the corridor, or sixteen seats in total. In this casing, two seats are arranged above the raised portion 48 and two more above the raised portion 50.

Because the reducing gears are assembled on the same side of the bogie, the circulation corridor is offset relative to the median plane of the body and parallel to the principal direction of the body.

The architecture of the bogie allows said bogie to be mounted under the body either pivoting about a pivot substantially perpendicular to the rolling plane of the vehicle, or not pivoting, in other words with an angular clearance of less than or equal to 2° relative to the body.

The bogie of FR-A-2 604 676 can only be non-pivoting relative to the body, because the motor is mounted under the body. The reducing gears which mechanically connect the motor to the axles could not tolerate changes of 12° in the orientation of the axles relative to the motor.

Because the primary suspensions are placed between the wheels, in other words inside and not outside the bogie relative to the wheels, it is possible to lower the side walls 60 of the body substantially to the axis of the wheels, or even lower, while giving them with a curved shape. As shown in FIG. 1, the walls 60 are not flat but, on the contrary, are slightly curved, and have a convexity turned towards the outside of the body. Moreover, this arrangement of the primary suspensions facilitates access to the wheels and brake discs to maintain or replace them.

The bogie and vehicle described above may have many variants.

The secondary suspensions of the bogie may be of any type, and may comprise for example spiral springs or chevron resilient devices. The bogie, both in the first and in the second embodiment, may comprise two or four secondary suspension components.

The axles connecting the front wheels and the rear wheels in rotation may be of any type. They may be of the cranked type, as described in EP-0 911 239. They may also be of the uncoupled type, as described in the application with filing number FR 06 00834.

The seats 20 situated above the raised portion 50 of the chassis may be oriented perpendicular to the seats 20 situated above the raised portion 48, in other words in such a way that the passengers are seated with their backs to the side wall 60.

All the primary suspension components may be of the chevron type. Conversely, all the primary suspension components may be low components situated entirely below a level of approximately 300 mm relative to the rolling plane of the bogie, for wheels with a diameter of 590 mm.

The railway vehicle may be a light vehicle of the tram type, or a heavier vehicle, for example a train for long or short journeys.

The invention claimed is:

1. A powered bogie for a railway vehicle, the bogie comprising:

a bogie chassis;

two front wheels transversely spaced apart from one another and two rear wheels transversely spaced apart from one another, the front and rear wheels being connected to the bogie chassis, the front wheels being longitudinally spaced apart from the rear wheels;

one or two driving motors; and a transmission comprising a front reducing gear for coupling the front wheels to the motor or one of the motors and a rear reducing gear for coupling the rear wheels to the motor or one of the motors;

the one or two motors being mounted on the bogie chassis, the one or two motors and the front and rear reducing gears being arranged between a first longitudinal plane and a second longitudinal plane, the first longitudinal plane passing midway between the two front wheels and midway between the two rear wheels, the second longitudinal plane passing through the front wheel and the rear wheel situated on a same, first transverse side of the bogie, the one or two motors being aligned longitudinally between the front and rear reducing gears.

2. The bogie according to claim 1, wherein the front and rear reducing gears are arranged in positions symmetrical to one another about a transverse plane midway between the front and rear wheels.

3. The bogie according to claim 1, further comprising braking elements for the front and rear wheels and secondary suspension components suitable for suspending a railway vehicle body on the bogie chassis, the braking elements and the secondary suspension components being situated outside the bogie relative to the wheels.

4. The bogie according to claim 1 further comprising primary suspension components situated between the transmission and the bogie chassis, the primary suspension components being placed inside the bogie relative to the wheels.

5. The bogie according to claim 4, wherein at least some primary suspension components are low components, each situated entirely below a level between 200 mm and 400 mm relative to the rolling plane of the bogie, for front and rear wheels with a diameter of 590 mm.

6. A railway vehicle comprising:

a body which is elongate in shape in a principal direction, provided with a body chassis; and at least one bogie connected to the body and arranged below the body chassis comprising:

a bogie chassis;

two front wheels transversely spaced apart from one another and two rear wheels transversely spaced apart from one another, the front and rear wheels being connected to the bogie chassis, the front wheels being longitudinally spaced apart from the rear wheels;

one or two driving motors; and a transmission comprising a front reducing gear for coupling the front wheels to the motor or one of the motors and a rear reducing gear for coupling the rear wheels to the motor or one of the motors;

the one or two motors being mounted on the bogie chassis, the one or two motors and the front and rear reducing gears being arranged between a first longitudinal plane and a second longitudinal plane, the first longitudinal plane passing midway between the two front wheels and midway between the two rear wheels, the second longitudinal plane passing through the front wheel and the rear wheel situated on a same, first transverse side of the bogie, the one or two motors being aligned longitudinally between the front and rear reducing gears;

the body chassis comprising a first raised portion above the front and rear wheels situated on the first transverse side of the bogie and above the front and rear reducing gears, a second raised portion at least above the front and rear wheels situated on a second transverse side of the bogie opposite the first transverse side, and a lowered portion forming a circulation corridor, substantially parallel to the principal direction, between the first and second raised portions.

7. The vehicle according to claim 6, wherein the circulation corridor is offset transversely towards the second raised portion relative to a median plane of the body and parallel to the principal direction.

8. The vehicle according to claim 6, wherein the bogie is connected to the body by a pivot connector.

9. The vehicle according to claim 6, wherein the bogie is non-pivoting relative to the body.

10. The vehicle according to claim 6, wherein the circulation corridor extends from the front and rear reducing gears on the first transverse side to the front and rear wheels situated on the second transverse side of the bogie.

11. The vehicle according to claim 6, wherein the bogie comprises primary suspension components arranged directly inside the bogie relative to the front and rear wheels situated on the second side of the bogie, the circulation corridor extending from the front and rear reducing gears to said primary suspension components.

* * * * *